US008220073B2

(12) United States Patent
Lopez et al.

(10) Patent No.: US 8,220,073 B2
(45) Date of Patent: Jul. 17, 2012

(54) LEG PROTECTION ARRANGEMENT

(76) Inventors: Domingo Lopez, Moreno Valley, CA (US); Virgina P Vera, Moreno Valley, CA (US)

( * ) Notice: Subject to any disclaimer, the term of this patent is extended or adjusted under 35 U.S.C. 154(b) by 676 days.

(21) Appl. No.: 12/252,526

(22) Filed: Oct. 16, 2008

(65) Prior Publication Data

US 2010/0095422 A1 Apr. 22, 2010

(51) Int. Cl.
*A41D 13/00* (2006.01)

(52) U.S. Cl. ..... 2/24

(58) Field of Classification Search ..... 2/22, 23, 2/24, 79, 227, 911, 310, 69, 238; 482/105, 482/120; 128/881, 882; 602/23, 26, 62
See application file for complete search history.

(56) References Cited

U.S. PATENT DOCUMENTS

| | | | | |
|---|---|---|---|---|
| D554,776 | S | 2/1896 | Davis et al. | |
| D926,328 | | 6/1909 | Horath et al. | |
| 1,269,829 | A | 6/1918 | Lumley | |
| 1,510,325 | A | 4/1922 | Landon | |
| 1,583,181 | A | 5/1926 | Rubio | |
| 2,603,786 | A | 7/1952 | Haines | |
| 4,294,238 | A | 10/1981 | Woodford | |
| 4,685,153 | A | 8/1987 | Sims | |
| 5,308,305 | A * | 5/1994 | Romney | 482/124 |
| 5,716,307 | A * | 2/1998 | Vadher | 482/125 |
| 5,937,441 | A * | 8/1999 | Raines | 2/69 |
| 6,361,517 | B1 * | 3/2002 | Slinger | 602/28 |
| 6,427,239 | B1 | 8/2002 | Worden | |
| 6,428,495 | B1 * | 8/2002 | Lynott | 602/23 |
| 7,096,507 | B1 | 8/2006 | Bolden | |
| 7,194,770 | B1 * | 3/2007 | Fecenko | 2/227 |
| 7,757,305 | B2 * | 7/2010 | Toso | 2/79 |

* cited by examiner

*Primary Examiner* — Tejash Patel
(74) *Attorney, Agent, or Firm* — QuickPatents, Inc.; Kevin Prince

(57) ABSTRACT

A protection device for a person's legs is disclosed that includes a knee pad means that has a concave portion for receiving the knee of the person, and further includes a protective covering. A pair of flexible upper straps each have a lower end coupled with the knee pad means, and an upper end adapted to be selectively coupled to the belt. Each upper strap mutually crosses at a point behind the person's upper leg. A pair of flexible lower straps each have an upper end coupled with the knee pad means, and a lower end adapted to be selectively coupled with one of the person's shoes proximate a heel thereof, either to a loop of the shoe or to a shoe-attachable ring of the invention.

20 Claims, 3 Drawing Sheets

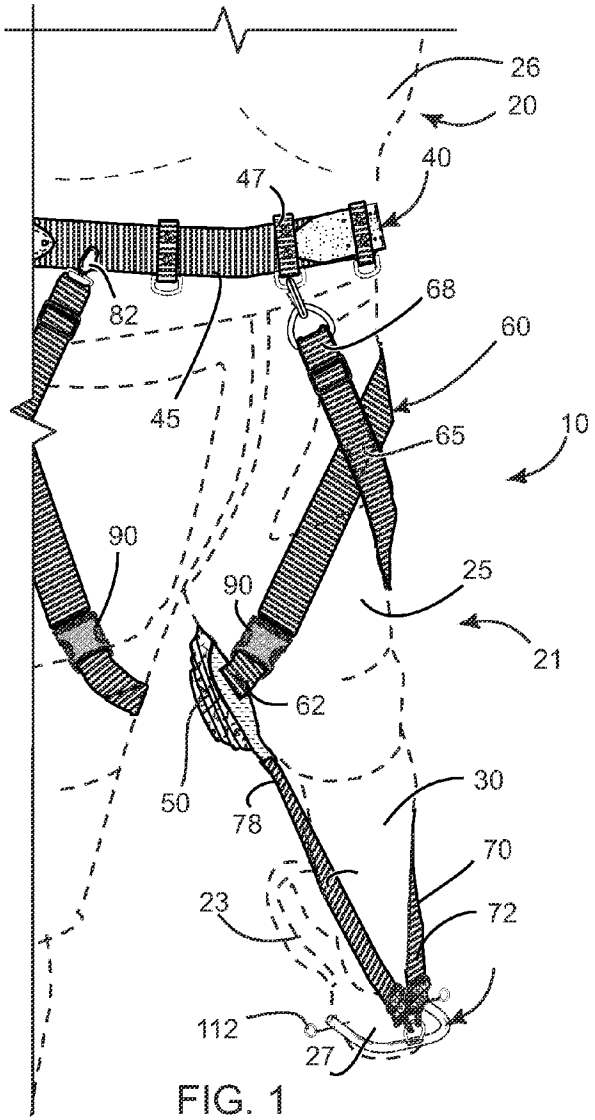
FIG. 1
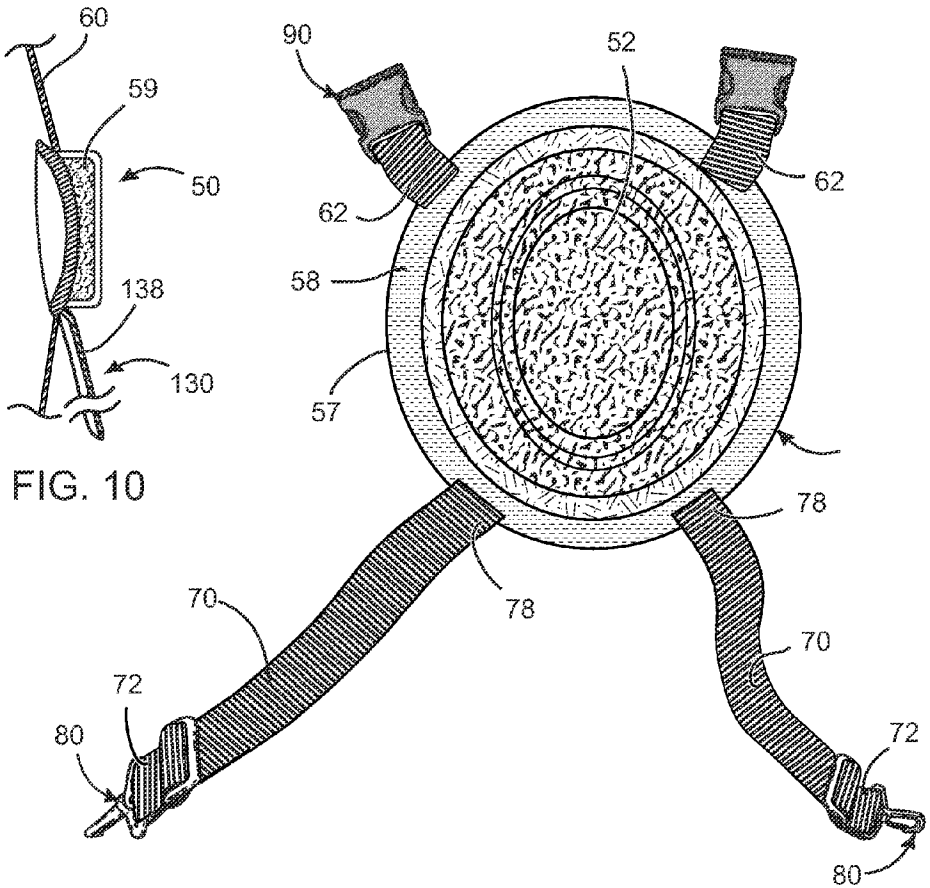
FIG. 2
FIG. 10

LEG PROTECTION ARRANGEMENT

CROSS-REFERENCE TO RELATED APPLICATIONS

Not Applicable.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to protective covers, and more particularly to an improved kneepad system.

DISCUSSION OF RELATED ART

Knee pads and leg protection devices are commonly used in construction, sports, and various fields where a person must frequently contact his knees to a ground surface. Almost without exception, prior art knee pad devices include some type of strap encircling the leg proximate the knee in order to hold a knee protective device in place at the front of the knee. A strap encircling the leg proximate the knee, so that the strap goes behind the knee around the back of the leg, is about the worst place for such a strap. As the person bends while performing an activity, the strap is easily shifted by contact with the back of the leg. Further, a person is prone to sweat directly behind the knee when crouched down for extended periods, and a strap traversing this area causes increased discomfort. For example, the following prior art patents all suffer from such drawbacks:

| Patent Number | Inventor | Date of Issue |
|---|---|---|
| 554,776 | Davis et al. | Feb. 18, 1896 |
| 926,328 | Horath et al. | Jun. 29, 1909 |
| 1,269,829 | Lumley | Jun. 18, 1918 |
| 1,583,181 | Rubio | May 4, 1926 |
| 2,603,786 | Haines | Jun. 22, 1952 |
| 4,294,238 | Woodford | Oct. 13, 1981 |
| 4,685,153 | Sims | Aug. 11, 1987 |
| 7,096,507 | Bolden | Aug. 29, 2006 |

Still further, with many such devices, the knee pad tends to rotate around the leg over time and with active use of the legs. As such, such devices must continuously be readjusted and repositioned. Those prior art devices that are linked in some way to the person's waist or feet have the advantage that the knee pads tend to stay properly positioned. However, any of these prior art devices with straps encircling the legs behind the knee suffer from the drawback that they're uncomfortable to use.

One prior art device, disclosed in U.S. Pat. No. 6,427,239 to Worden on Aug. 6, 2002, teaches a knee pad device that spans the distance from the user's knee to his shin, and straps wrap around the person's shin to fix the device to the user's leg. As such, this type of device does not have straps traversing the back side of the knee. However, such a device tends to clap irritatingly against the knee while the person walks. Further, upon impact between the knee and an object, such a device, being cantilevered, can swing away from the knee easily and fail to adequately protect the knee.

Another prior art device, disclosed in U.S. Pat. No. 1,510,325 to Landon on Sep. 30, 1924, teaches a knee pad that is connected with straps between a person's lower garment and a pair of socks. While the straps of such a device are elastic and therefore stretch as the person flexes his knees, significant force can be applied to the person's lower garment while such a device is in use, and thus care must be taken to ensure the lower garment does not pull down undesirably during physical activity. Further, with a knee pad held by straps close to the front of the person's body, there is a tendency when the person stands for the knee pad to fall out of place. As such, even with such a device, the person must continuously readjust and reposition the knee pad during use.

Therefore, there is a need for a device that protects the user's knees and legs while in use, yet is comfortable to wear and stays properly positioned during use. Such a needed device would be adaptable to various garments, shoes and belts worn by the user, and would allow for quickly changing of a knee pad of the device as desired. The present invention accomplishes these objectives.

SUMMARY OF THE INVENTION

The present device is a protection device for a person's legs. The person needs to be wearing at least shoes on his feet, a lower garment such as work pants, and a belt encircling the person's waist. In one embodiment, the belt is included as part of the invention. In another embodiment, the invention utilizes the person's existing belt.

The protection device includes a knee pad means that has a concave portion for receiving the knee of the person, and further includes a protective covering. A pair of flexible upper straps each have a lower end coupled with the knee pad means, and an upper end adapted to be selectively coupled to the belt. Each upper strap mutually crosses at a point behind the person's upper leg.

A pair of flexible lower straps each have an upper end coupled with the knee pad means, and a lower end adapted to be selectively coupled with one of the person's shoes proximate a heel thereof. When the shoes of the person include a loop fixed proximate the heel thereof, as is common with some shoes, a spring clip fixed to the lower end of each lower strap may selectively capture such a loop of the person's shoes. Alternately, the protective device may further include a shoe-attachable ring that includes a U-shaped bracket for encompassing the heel and fixing to the shoe. Alternately, a shoe insert may be included for insertion into the shoe and under the person's foot.

The present invention protects the user's knees and legs while in use, yet is comfortable to wear and stays properly positioned during use. The present device is adaptable to various garments, shoes and belts worn by the user, and allows for quickly changing of a knee pad of the device as desired. Other features and advantages of the present invention will become apparent from the following more detailed description, taken in conjunction is with the accompanying drawings, which illustrate, by way of example, the principles of the invention.

DESCRIPTION OF THE DRAWINGS

FIG. 1 is a perspective view of a leg protection device of the invention in use;

FIG. 2 is a front elevation view of a knee pad assembly of the invention;

FIG. 10 is a partial side elevational view of a shin protection means of the invention.

DETAILED DESCRIPTION OF THE PREFERRED EMBODIMENT

Figure 3:
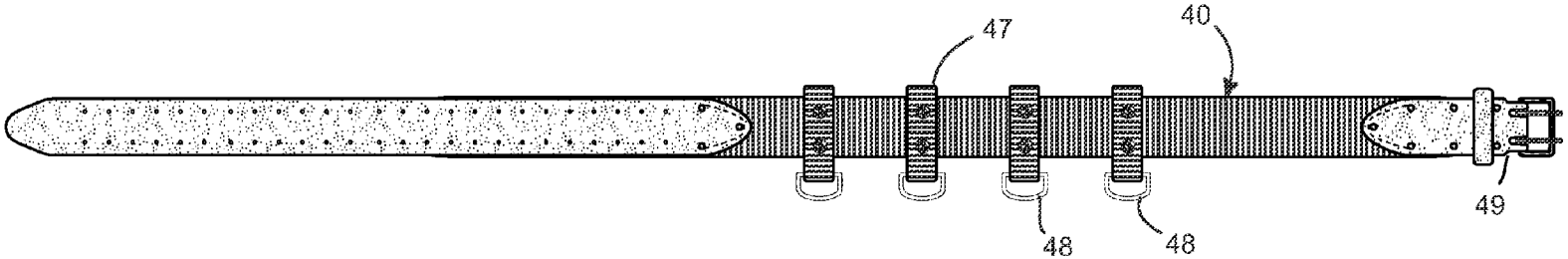
FIG. 3 is an elevation view of a belt assembly of the invention.

Illustrative embodiments of a protection device for a person's legs are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

FIGS. 1 and 2 illustrate a protection device 10 for a person's legs 21. The person 20 is wearing at least shoes 23 on his feet 22, a lower garment 30 such as work pants, and a belt 40 encircling the person's waist 26. In one embodiment, the belt 40 is included as part of the invention. In another embodiment, the invention utilizes the person's existing belt 40.

The protection device 10 includes a knee pad means 50 that has a concave portion 52 for receiving the knee 24 of the person 20, and further includes a protective covering 57. The protective covering 57 may be a foam cushion 58, for example, or a gel-filled cushion 59.

A pair of flexible upper straps 60 each have a lower end 62 coupled with the knee pad means 50, and an upper end 68 adapted to be selectively coupled to the belt 40. Each upper strap 60 mutually crosses at a point 65 behind the person's upper leg 25. Each upper strap 60 may further be mutually fixed to the other upper strap 60 at the point 65 by a sewn stitch 66, ultrasonic welding, or the like. The protection device 10 further includes a plurality of belt loops 47 that are each engageable with the belt 40 and cooperate with the upper end 68 of each upper strap 60 for selective coupling thereto (FIG. 4, 7A-7C), preferably on a back side of the person 20 so as to keep tension between each upper strap 60 and the knee pad means 50. Each belt loop 47 may be incorporated into the belt 40 as part of the invention, or in another embodiment made from a strap material 150 having two ends 155, each with mechanical fasteners 158 for selectively engaging the strap material 150 around the belt 40. Each belt loop 48 preferably includes a ring 48, such as a metallic ring 48. The upper end 68 of each upper strap 60 preferably includes a fastener clip 80, such as a manually actuable spring clip 81 that is spring biased in a closed position, adapted to selectively capture at least one of the rings 48 (FIG. 1). Alternately, the upper end 68 of each upper strap 60 includes a manually-actuable alligator clamp 82, or the like (FIG. 1). The belt 40, in the embodiment of the invention that includes the belt 40, further preferably includes an adjustable belt buckle 49 for allowing the circumference of the belt 40 to be adjustably sized to the size of the person's waist 26.

Figure 5:
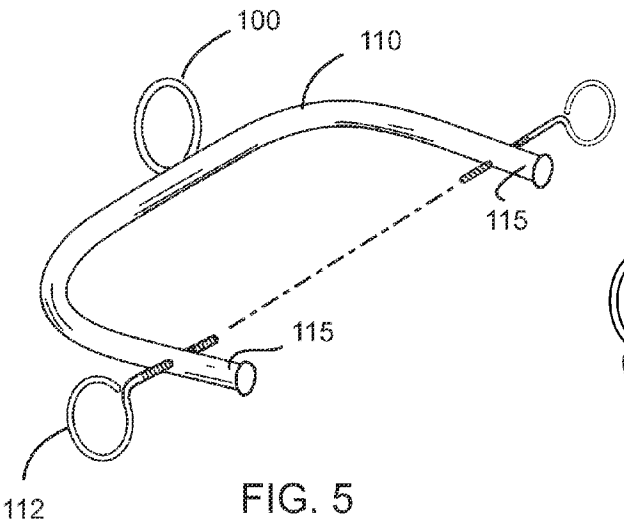
FIG. 5 is a perspective elevation view of a shoe clamp of the invention.
Figure 6:
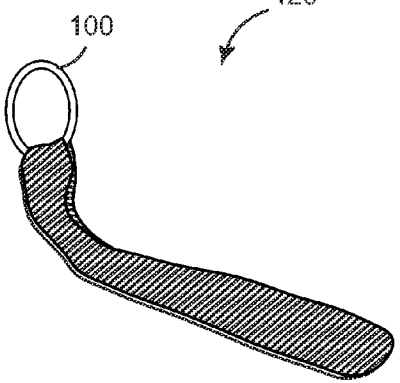
FIG. 6 is a perspective view of a shoe insert of the invention.
Figure 4:
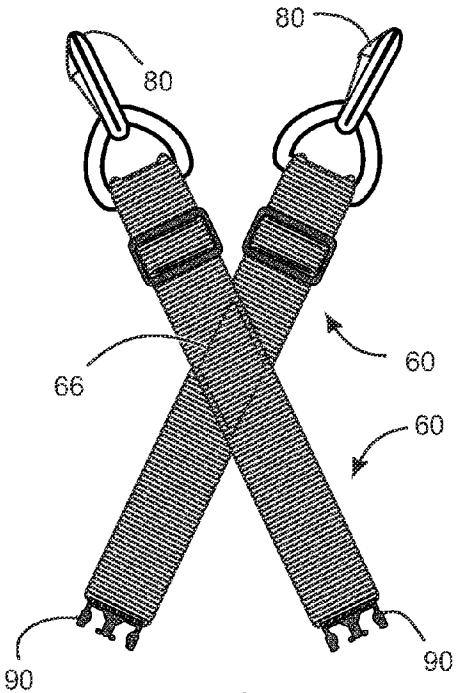
FIG. 4 is an elevation view of a cross strap assembly of the invention.
Figure 8:
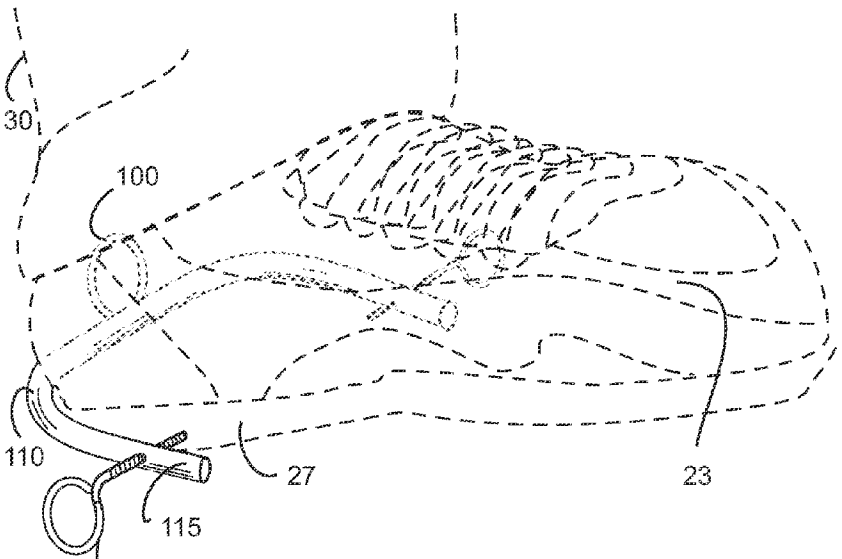
FIG. 8 is a perspective elevation view of a shoe clamp secured to a shoe.
Figure 9:
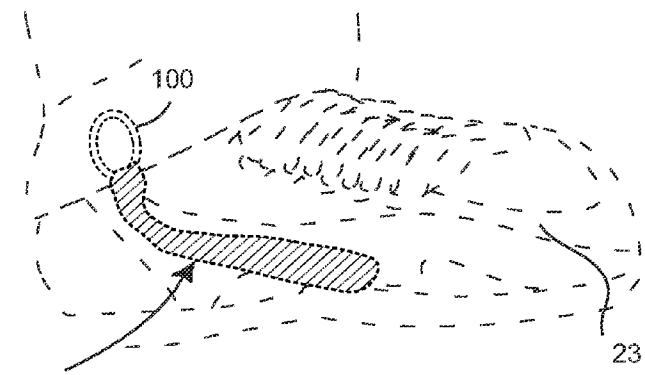
FIG. 9 is a perspective view of the shoe insert as used in the shoe.
Figure 7C:
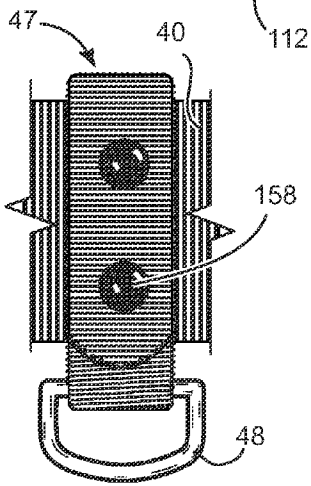
FIG. 7C is an elevation view of the belt loop of the present invention in a closed.
Figure 7B:
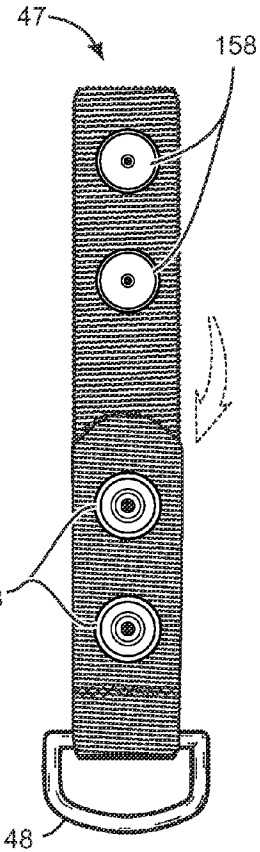
FIG. 7B is an elevation view of the belt loop of the present invention in the open position and an aligned position.
Figure 7A:
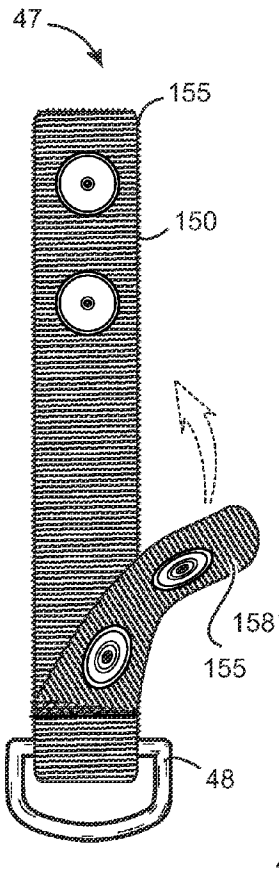
FIG. 7A is an elevation view of a belt loop of the present invention in an open position.

A pair of flexible lower straps 70 each have an upper end 72 coupled with the knee pad means 50, and a lower end 72 adapted to be selectively coupled with one of the person's shoes 23 proximate a heel 27 thereof. The lower end 72 of each lower strap 70 may include the manually actuable spring clip 81, or other fastener clip 80, for example. When the shoes 23 of the person include a loop (not shown) fixed proximate the heel 27 thereof, as is common with some shoes 23, such a spring clip 81 may selectively capture such a loop of the person's shoes 23. Alternately, the protective device 10 may further include a shoe-attachable ring 100 (FIG. 5) for fixing to each of the person's shoes 23 proximate the heel 27 thereof. Such a shoe attachable ring 100 may include a U-shaped bracket 110 for encompassing the heel 27 of the shoe 23. Such a U-shaped bracket 110 further includes a pair of threaded shoe bolts 112 traversing each of two ends 115 of the U-shaped bracket 110 and the heel 27 of the shoe 23. Alternately, a shoe insert 120 (FIG. 6) may be included for insertion into the shoe 23 and under the person's foot 22. Such a shoe insert 120 has the shoe attachable ring 100 fixed thereto such that the ring 100 projects out of the shoe 23 proximate the heel 27 thereof. Such a U-shaped bracket 110 and shoe insert 120 may be made of metal, for example, or a substantially rigid and strong plastic material.

Either or both of each strap 60,70 may further include a selectively engageable buckle 90 (FIGS. 1, 2 and 4) along its length, such that the kneepad means 50 may be selectively is removed and replaced without requiring the detachment of each upper strap 60 from the belt and each lower strap 70 from person's shoes 23. Either or both of each strap 60,70 may be made from an elastic material, a non-elastic nylon strap material, or the like.

A shin protection means 130, such as an energy-absorbing shin-pad (FIG. 10), may be further fixed to the knee pad means 50 at a top end 138 thereof. Such a shin protection means 130 may be useful when the leg protection device 10 of the present invention is used during sports play, such as baseball, for example.

With the upper straps 60 crossing at the point 65 behind the person's upper leg 25 and being fixed at their upper ends 68 to the person's belt 40 at the person's back side, a slight tension is kept on the straps 60 to hold the knee pad means 50 in place, regardless of the person's leg position. Likewise, with the lower end 72 of each lower strap 70 fixed to a shoe 23 of the person proximate the person's heal 27, tension is kept on each strap 70 to hold the knee pad means 50 in place, regardless of leg position. This method is effective because the length of the person's legs doesn't change even when he is bending or straightening his knees 24.

While a particular form of the invention has been illustrated and described, it will be apparent that various modifications can be made without departing from the spirit and scope of the invention. For example, each strap 60,70 may be made from a round cord as opposed to a flat strap material, as illustrated. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A protection device for a person's legs, the person wearing at least shoes on his feet, a lower garment, and a belt encircling the person's waist, the protection device comprising:

a knee pad for each knee having a concave portion for receiving the knee of the person and an outer protective covering;

two flexible upper straps in a pair for each knee, each upper strap having a lower end coupled with the knee pad and an upper end adapted to be selectively coupled to the belt, each upper strap of the pair mutually crossing at a point behind the person's upper leg, each upper strap mutually fixed to the other upper strap of the pair at the point behind the person's upper leg by a sewn stitch; and two flexible lower straps in a pair for each knee, each lower strap having an upper end coupled with the knee pad and a lower end adapted to be selectively coupled with one of the person's shoes proximate the heel thereof.

2. The protection device of claim 1 wherein the outer protective covering of the kneepad includes a foam cushion.

3. The protection device of claim 1 wherein the outer protective covering of the kneepad includes a gel-filled cushion.

4. The protection device of claim 1 further including a plurality of belt loops each engageable with the belt and cooperative with the upper end of each upper strap for selective coupling thereto.

5. The protection device of claim 4 wherein each belt loop further includes a ring, and wherein the upper end of each upper strap includes a clip adapted to selectively capture one of the rings.

6. The protection device of claim 1 wherein each upper strap further includes a selectively engageable buckle along its length, whereby the kneepad may be quickly removed and replaced without requiring the detachment of each upper strap from the belt.

7. The protective device of claim 1 wherein at least one of the straps is made from an elastic material.

8. The protective device of claim 1 wherein the person's shoes are of the type having a loop fixed proximate the heel of thereof and wherein the lower end of each lower strap includes a clip adapted to selectively capture the loop of one of the person's shoes.

9. A protection device for a person's legs, the person wearing at least shoes on his feet, a lower garment, and a belt encircling the person's waist, the protection device comprising:

a knee pad for each knee having a concave portion for receiving the knee of the person and an outer protective covering;

two flexible upper straps in a pair for each knee, each upper strap having a lower end coupled with the knee pad and an upper end adapted to be selectively coupled to the belt, each upper strap of the pair mutually crossing at a point behind the person's upper leg;

two flexible lower straps in a pair for each knee, each lower strap having an upper end coupled with the knee pad and a lower end adapted to be selectively coupled with one of the person's shoes proximate the heel thereof; and a shoe-attachable ring for fixing to each of the person's shoes proximate the heel thereof, the lower end of each lower strap including a clip adapted to selectively capture one of the shoe-attachable rings.

10. The protective device of claim 9 wherein the shoe-attachable ring further includes a U-shaped bracket for encompassing the heel of the shoe, the U-shaped bracket further including a pair of threaded shoe bolts traversing each of two ends of the U-shaped bracket and the heel of the shoe.

11. The protective device of claim 9 further including a shoe insert adapted for insertion in the shoe and under the person's foot, the shoe insert being fixed to the shoe-attachable ring, the shoe-attachable ring projecting out of the shoe proximate the heel thereof.

12. The protective device of claim 1 wherein the knee pad further includes a means for protecting the shin.

13. A protection device for a person's legs, the person wearing at least shoes on his feet, a lower garment, and a belt encircling the person's waist, the protection device comprising:

a knee pad for each knee having a concave portion for receiving the knee of the person and an outer protective covering;

two flexible upper straps in a pair for each knee, each upper strap having a lower end coupled with the knee pad and an upper end adapted to be selectively coupled to the belt, each upper strap of the pair mutually crossing at a point behind the person's upper leg, each upper strap mutually fixed to the other upper strap of the pair at the point behind the person's upper leg by ultrasonic welding; and two flexible lower straps in a pair for each knee, each lower strap having an upper end coupled with the knee pad and a lower end adapted to be selectively coupled with one of the person's shoes proximate the heel thereof.

14. The protection device of claim 13 wherein the outer protective covering of the kneepad includes a foam cushion.

15. The protection device of claim 13 wherein the outer protective covering of the kneepad includes a gel-filled cushion.

16. The protection device of claim 13 further including a plurality of belt loops each engageable with the belt and cooperative with the upper end of each upper strap for selective coupling thereto.

17. The protection device of claim 16 wherein each belt loop further includes a ring, and wherein the upper end of each upper strap includes a clip adapted to selectively capture one of the rings.

18. The protection device of claim 13 wherein each upper strap further includes a selectively engageable buckle along its length, whereby the kneepad may be quickly removed and replaced without requiring the detachment of each upper strap from the belt.

19. The protective device of claim 13 wherein at least one of the straps is made from an elastic material.

20. The protective device of claim 13 wherein the person's shoes are of the type having a loop fixed proximate the heel of thereof and wherein the lower end of each lower strap includes a clip adapted to selectively capture the loop of one of the person's shoes.

* * * * *